US011698204B1

(12) United States Patent
Esmaili

(10) Patent No.: US 11,698,204 B1
(45) Date of Patent: Jul. 11, 2023

(54) AUTOMATION AND OPTIMIZATION OF FUEL FEED TO HEATING ELEMENTS OF HEATING, VENTILATION, AND AIR CONDITIONING (HVAC) SYSTEMS

(71) Applicant: Houshang Esmaili, Oakland, CA (US)

(72) Inventor: Houshang Esmaili, Oakland, CA (US)

( * ) Notice: Subject to any disclaimer, the term of this patent is extended or adjusted under 35 U.S.C. 154(b) by 0 days.

(21) Appl. No.: 17/832,655

(22) Filed: Jun. 5, 2022

(51) Int. Cl.
*F24F 11/47* (2018.01)
*F24F 140/60* (2018.01)
*F24F 110/10* (2018.01)

(52) U.S. Cl.
CPC ..... *F24F 11/47* (2018.01); *F24F 2110/10* (2018.01); *F24F 2140/60* (2018.01)

(58) Field of Classification Search
CPC ..... F24F 11/47; F24F 2140/60; F24F 2110/10
See application file for complete search history.

(56) References Cited

U.S. PATENT DOCUMENTS 4,347,974 A 9/1982 Pinckaers et al.
4,660,759 A 4/1987 Barnard et al.
5,337,955 A * 8/1994 Burd ..... F24D 19/1009 236/91 B
5,931,227 A 8/1999 Graves
6,098,893 A 8/2000 Berglund et al.
6,145,752 A 11/2000 Jackson
7,337,837 B2 3/2008 Edwards
7,448,435 B2 11/2008 Garozzo
7,720,635 B2 5/2010 Donath et al.
7,809,472 B1 10/2010 Silva et al.
7,848,900 B2 12/2010 Steinberg et al.
7,908,116 B2 3/2011 Steinberg et al.
(Continued)

FOREIGN PATENT DOCUMENTS

CN 115013861 A * 9/2022
DE 102004008521 B3 * 10/2005 ..... G01K 17/06
(Continued)

OTHER PUBLICATIONS

Haines, Roger W., and Michael E. Myers. 2010. HVAC Systems Design Handbook. 5th ed. New York: McGraw-Hill Education. (Year: 2010).*
(Continued)

*Primary Examiner* — Ronald D Hartman, Jr.
(74) *Attorney, Agent, or Firm* — Morrison & Foerster LLP

(57) ABSTRACT

This Patent application is based on a new method for calculating the hourly heating load for the heating elements of HVAC systems, with a potential for saving over 50% of the current fuel use by these systems. The method is based on using hourly outside air temperature from one or more thermometer installed along the vertical center of each of the building's orientations, and at the roof center. The temperature data, the building surface areas with different heat transmission characteristics in each orientation, plus hourly air infiltration rate into the building, adjusted for overall system efficiency, and Codes and regulatory requirements would yield the total hourly heating load. The fuel feed would then be automatically adjusted to release the hourly required fuel volume, or wattage, to the heating elements. The installed thermometer system could also be used to calculate the hourly cooling load for the building's air conditioning system, during the summer season.

17 Claims, 3 Drawing Sheets

Figure 1:
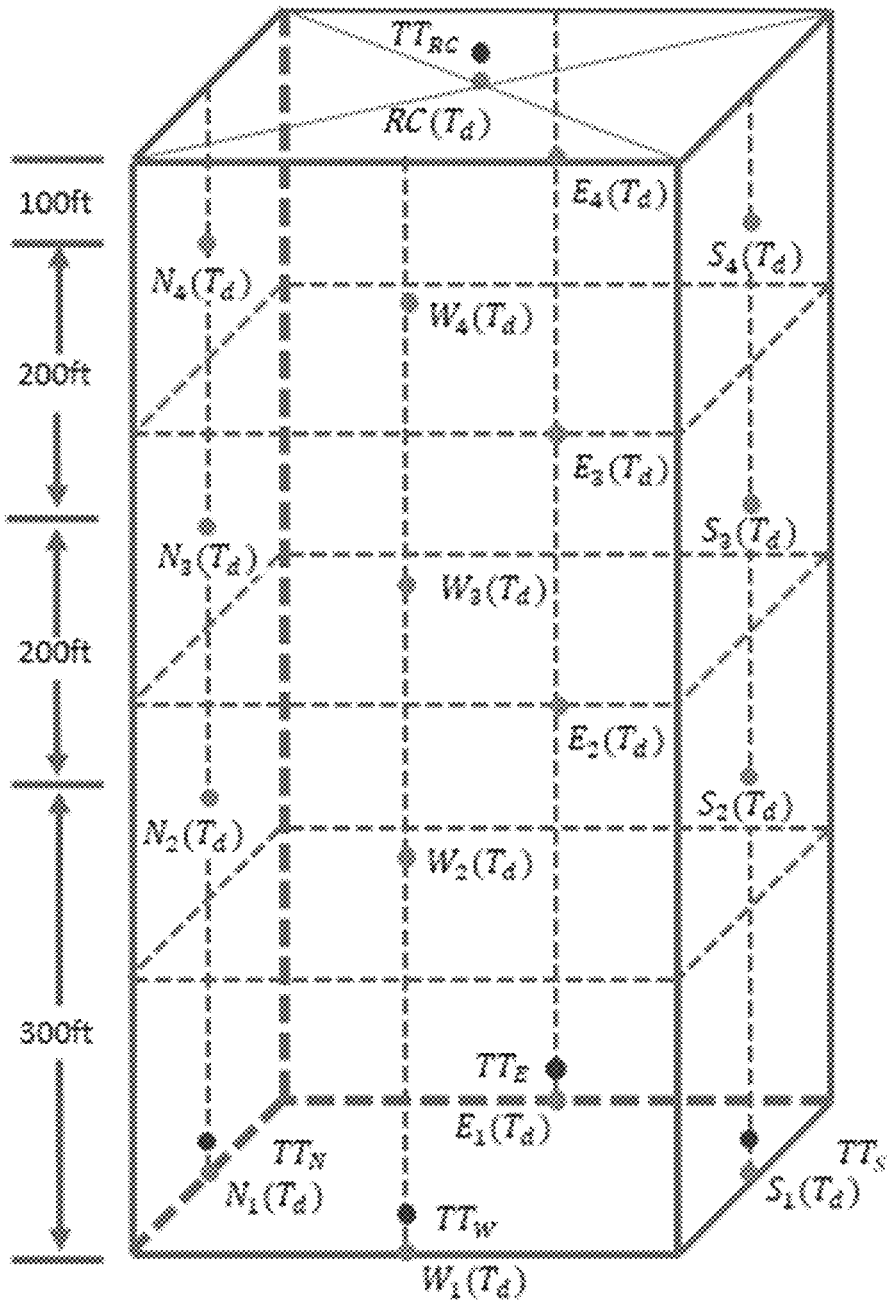

Schematic diagram of a high-rise building and associated thermometers and data transmitters.

(56) References Cited

U.S. PATENT DOCUMENTS

| | | | | |
|---|---|---|---|---|
| 7,908,117 | B2 | 3/2011 | Steinberg et al. | |
| 8,019,567 | B2 | 9/2011 | Steinberg et al. | |
| 8,022,647 | B1 | 9/2011 | Davis et al. | |
| 8,108,075 | B2 | 1/2012 | Bohan, Jr. | |
| 8,412,488 | B2 | 4/2013 | Steinberg et al. | |
| 8,423,322 | B2 | 4/2013 | Steinberg et al. | |
| 8,676,397 | B2 | 3/2014 | Longobardi et al. | |
| 8,738,327 | B2 | 5/2014 | Steinberg et al. | |
| 8,770,492 | B2 | 7/2014 | Jang et al. | |
| 8,781,634 | B2 | 7/2014 | Kim et al. | |
| 8,930,030 | B2 | 1/2015 | Bester et al. | |
| 9,982,903 | B1 * | 5/2018 | Ridder | F24F 11/70 |
| 2008/0120068 | A1 * | 5/2008 | Martin | G06F 30/13 703/1 |
| 2009/0271154 | A1 * | 10/2009 | Coad | G06F 30/18 703/1 |
| 2012/0271576 | A1 * | 10/2012 | Kamel | G06Q 10/10 702/62 |
| 2013/0030592 | A1 * | 1/2013 | Magori | G06Q 10/0637 700/295 |
| 2013/0338837 | A1 * | 12/2013 | Hublou | G05D 23/1923 700/278 |
| 2014/0121842 | A1 * | 5/2014 | Nodson | F24F 11/58 700/276 |
| 2017/0268797 | A1 * | 9/2017 | Mowris | G05D 23/1951 |
| 2019/0354071 | A1 * | 11/2019 | Turney | G06F 30/20 |
| 2021/0381861 | A1 * | 12/2021 | Brown | G05D 27/02 |
| 2022/0404056 | A1 * | 12/2022 | Bloemer | F24F 11/52 |

FOREIGN PATENT DOCUMENTS

| | | | | |
|---|---|---|---|---|
| EP | 1113373 | A2 * | 7/2001 | G06F 17/5095 |
| EP | 2009358 | A2 * | 12/2008 | F24D 19/1009 |
| GB | 2365579 | A * | 2/2002 | G06F 17/5095 |
| JP | 2003056855 | A * | 2/2003 | |
| JP | 4264501 | B2 * | 5/2009 | |

OTHER PUBLICATIONS

2017 ASHRAE Handbook, Fundamentals, Supported by ASHRAE Research. Chapter 18—"Nonresidential Cooling and Heating Load Calculations", Section 9.2 Single Room Example Peak Heating Load, p. 18.24.

2019 ASHRAE Handbook, HVAC Applications, Supported by ASHRAE Research. Chapter 43—"Supervisory Control Strategies and Optimization", Section 3.10—Control Strategies for Heating Systems.

2020 ASHRAE Handbook, HV AC Systems and Equipment, Supported by ASHRAE Research. Chapter 32—Boilers, Section 7, Boiler Controls.

EPA. "Sources of Greenhouse Gas Emissions", U.S. Environmental Protection Agency, 2022, Web Publications:, Waybak Machine: https://web.archive.org/web/20230227044543/https://www.epa.gov/ghgemissions/ sources-greenhouse-gas-emissions.

U.S. National Weather Service, Hourly Weather Data for Atlanta International Airport, Dec. 20, 2020, to Mar. 22, 2021.

WEA Product Catalog. (Apr. 2022). Example of Manufacturer of Electronic Wireless Thermometers and Transmitters, www.Vaisala.com.

* cited by examiner

Schematic diagram of a high-rise building and associated thermometers and data transmitters.

Legend for Figure 1

$N_1(T_d)$ — Dry Bulb Electronic Thermometer No. 1 Located Along the Vertical Centerline of the Building's North Orientation $TT_N$ – Air Temperature Transmitter Located Near N1(Td) Thermometer $S_1(T_d)$ — Dry Bulb Electronic Thermometer No. 1 Located Along the Vertical Centerline of the Building's South Orientation $TT_S$ – Air Temperature Transmitter Located Near S1(Td) Thermometer $E_1(T_d)$ — Dry Bulb Electronic Thermometer No. 1 Located Along the Vertical Centerline of the Building's East Orientation $TT_E$ – Air Temperature Transmitter Located Near E1(Td) Thermometer $W_1(T_d)$ — Dry Bulb Electronic Thermometer No. 1 Located Along the Vertical Centerline of the Building's West Orientation $TT_W$ - Air Temperature Transmitter Located Near W1(Td) Thermometer RC $(T_d)$ — Dry Bulb Electronic Thermometer Located Near the Schematic Building's Roof Center $TT_{RC}$ – Air Temperature Transmitter Located Near RC(Td) Thermometer (continued)

FIG. 2: Flow Chart for the Required Sequential Steps for HVAC Heating System Fuel Feed Automation and Optimization
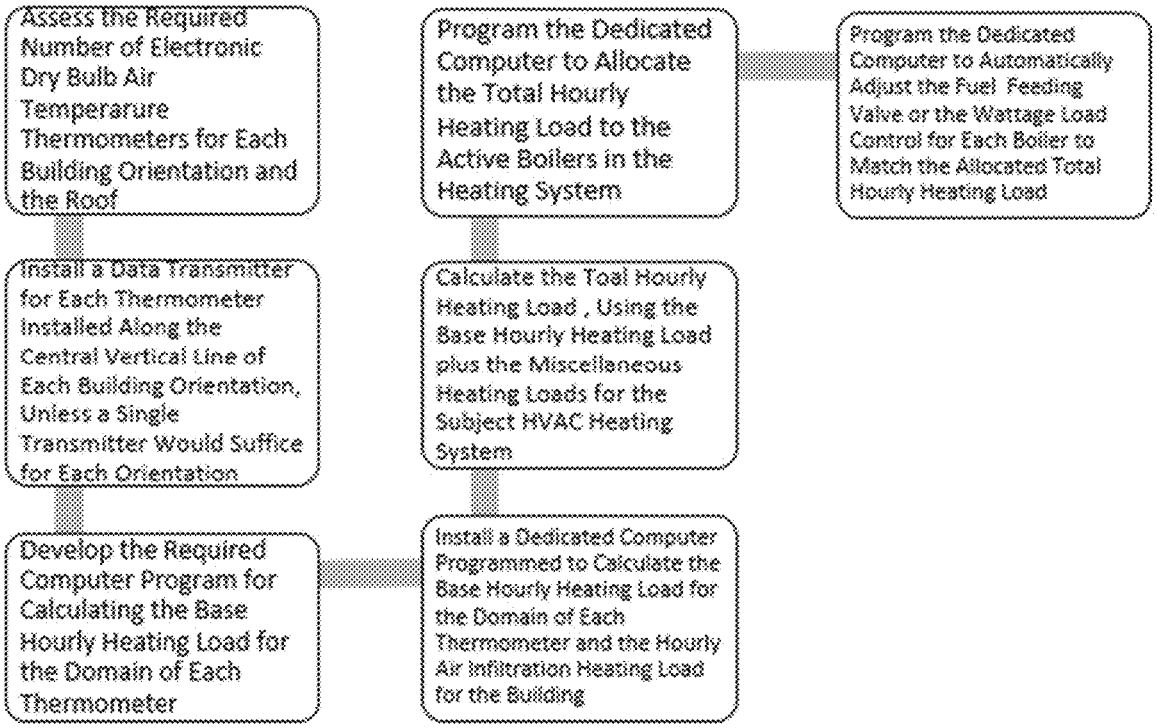

AUTOMATION AND OPTIMIZATION OF FUEL FEED TO HEATING ELEMENTS OF HEATING, VENTILATION, AND AIR CONDITIONING (HVAC) SYSTEMS

BACKGROUND OF THE INVENTION

Currently, the Design Heating Load (DHL) for HVAC heating systems is developed based on the estimated, local, annual minimum outside air temperature. Also, fuel feed to the heating elements of HVAC systems in major buildings is set, mostly, manually, and at a higher level than the optimum level required by outside air temperature conditions.

The 2017 American Society of Heating, Refrigeration, and Air Conditioning Engineers (ASHRAE) Handbook, Fundamentals, Chapter 18—Nonresidential Cooling and Heating Load Calculations, Section 9.2—Single Room Example Peak Heating Load, Page 18.54, describes the current method for calculating the DHL for HVAC heating systems. This method could be expressed by the following formula for estimating the DHL for a single room building:

$$Q=(\Sigma_{i=1}^{n}U(i)*A(i))*\Delta T+I*H*\Delta T \quad \text{—1—}$$

Where:

Q=Design Peak Hourly Heating Load, BTU/hour

U=Heating Load Factor for various exterior surfaces of the building, BTU/hr.-sq. ft.-degree F.

A=Area of various exterior surfaces of the building with different thermal transmission characteristics, sq. ft.

n=The number of designated exterior building surfaces used for heating load calculation I=Outside Air infiltration into the building, at the rate of one air change per hour, or 19.5 cfm., for the single room building.

H=Outside air heating load factor of 1.1 (BTU/hr.-cfm-degree F.)

ΔT=Difference between selected optimum indoor temperature of 72-degree F. and the selected annual dry bulb low outside air temperature of 21.9-degree F., for Atlanta, Ga.

The summary of 2017 ASHRAE Handbook calculations for estimated base DHL, for a single room building in Atlanta, Ga. is shown in Table 1.

TABLE 1

Estimated HVAC Base Design Peak Hourly Heating Load for A Single Room Building in Atlanta, Georgia

| Single Room Exterior Elements | Area, sq ft | Heating Load Factor, BTU/hr.-sq. ft.-degree F. | ΔT, degree F. | Base Design Peak Hourly Heating Load, BTU/hr. |
|---|---|---|---|---|
| Windows | 80 | 0.56 | (72-21.9) | 2,244 |
| Spandrel Wall | 120 | 0.077 | (72-21.9) | 463 |
| Brick Wall | 100 | 0.08 | (72-21.9) | 401 |
| Roof | 130 | 0.032 | (72-21.9) | 208 |
| Air Infiltration | 19.5 (cfm) | 1.1 (BTU/hr.-cfm-degree F.) | (72-21.9) | 1,075 |
| Total | | | | 4,391 |

Source: 2017 ASHRAE Handbook, Fundamentals (Chapter 18, Section 9.2, Page 18.54)

A comprehensive discussion of supervisory control and optimization of HVAC systems is presented in the 2019 ASHRAE Handbook, HVAC Applications, Chapter 43—Supervisory Control Strategies and Optimization, Section 3.10—Control Strategies for Heating Systems. Modern boilers are designed to achieve enhanced efficiency by automatically controlling the air-fuel mixture ratio in boiler's burners and maintaining this ratio at an optimum level at all times. This goal can be achieved by continuous monitoring of either the oxygen or carbon monoxide level, in the flue gas emitted in the boiler stack, and adjusting the burner's air-fuel mixture ratio to achieve maximum fuel burning efficiency. This feature of the modern boilers could also aid in automatic adjustment of the burner's air-fuel mixture when the fuel input is adjusted based on hourly outside air temperature data, as proposed in this invention. Sequencing and loading of multiple boilers, and boiler supply water pressure and temperature reset values, are also managed in the existing boiler control system. This ASHRAE Handbook article does not address any use of hourly outside air temperature measurements for automating and optimizing the operation of the boiler units.

Boiler controls are also discussed in the 2020 ASHRAE Handbook, HVAC Systems and Equipment, Chapter 32—Boilers, Section 7—Boiler Controls. This document summarizes the current state of burner and boiler performance as follows: "Boiler controls provide automatic regulation of burner and boiler performance to ensure safe and efficient operation. Operating and combustion controls regulate the rate of fuel input in response to a signal representing load change (demand), so that the average boiler output equals the load within some accepted tolerance." The heating load estimates referred to in this Handbook's article are mainly derived from the building's internal load signals and do not indicate the use of any Hourly Heating Load (HHL) values. Various control measures, incorporated in modern boiler systems, are described in detail in this article.

U.S. Pat. No. 6,098,893 (Issued in year 2000 to Honeywell Corporation with Inventor Stefan Bergland) "Comfort Control System Incorporating Weather Forecast Data and a Method for Operating Such a System". This patent proposes the establishment of a commercial entity that would receive weather forecast data, interpret, the forecasts, and transmit recommendations to multi building entities to adjust their system controls to optimize their operation during each weather episode. The Patent does not indicate the measurement or use of any hourly air temperature data and appears to require extensive staffing for carrying out the proposed method. Also, the Claim for energy savings achieved by the invention is not quantified and is only shown in a graph without calibrated or labelled scales.

Based on U.S. Environmental Protection Agency Publication (epa.gov/ghgemissions/sources-greenhouse-gas-emissions), the annual greenhouse gas emissions, from commercial and residential building operations, was 1,733 million tons, constituting about 13% of the year 2020 annual GHG emissions in the U.S. A significant portion of these emissions were generated by fossil fuel consumption in building heating operations. Widespread adoption of the invention described in this Patent Application could result in a significant reduction in these emissions in the U.S. and abroad.

BRIEF SUMMARY OF THE INVENTION

The focus of this invention is on automating and optimizing the fuel feed to heating elements of HVAC Systems. The hourly heating load would, therefore, be automatically calculated, by using the hourly outside air temperature values, measured at single purpose dry bulb electronic thermometers, located at or near the vertical center line of various orientations of the building and in the center of the building's roof. The measured hourly outside air temperature data, for each building orientation and the roof, would be transmitted to dedicated computers and used with the stored data on square footage, and the heat transfer coefficients of each orientation subarea and the roof, with distinct heat transmission characteristics, to calculate the hourly heating load. This value, plus the heating load of the required hourly air infiltration rate, would constitute the base hourly heating load for the building. The base hourly heating load would then be adjusted based on overall efficiency of the HVAC heating system, load requirements for internal building operations and equipment, Code and regulatory compliance requirements, and manufacturer specifications, to arrive at the total hourly heating load. The hourly fuel feed rate to the heating elements of the HVAC System would be determined based on the calculated total hourly heating load and would be automatically supplied to the heating system. This invention is, therefore, focused on implementing a more efficient method for operating the heating system for a building and could be carried out by using the available equipment and technology to measure the outside air temperature, calculate the hourly total heating load, and supply the fuel feed to the heating elements to meet the calculated heating requirement. All downstream functions such as air-fuel mixture determination and coordination of multiple heating elements would be carried out as designed in the HVAC systems.

For major high-rise buildings the number and height of the required thermometers, along the central vertical line of each building orientation, would need to be determined by conducting an experiment during the winter season by installing temporary thermometers, at 5 to 10 floors spacing, to evaluate the required number of permanent thermometers in each building orientation. Due to physical constraints for installing dry bulb thermometers on the exterior of existing high-rise buildings, it may be necessary to limit such thermometers to the minimum required to obtain an accurate profile of outside air temperature along each building orientation.

DETAILED DESCRIPTION OF THE INVENTION

This invention is based on implementing hourly outside air temperature monitoring and automatic calculation of hourly heating load for heating elements of HVAC systems as described in this section.

Single Room Hourly Heating Load (HHL) Calculation Method. This section provides a comparison between the calculated ASHRAE Design Heating Load, and the Hourly Heating Load developed by the method proposed in this invention, for maintaining the indoor air temperature at 72° F., during the winter season in a single room building. The HHL was calculated by using the hourly outside dry bulb air temperature data published by the U.S. National Weather Service, for the winter season period (Dec. 20, 2020, through Mar. 22, 2021), for Atlanta International Airport, as shown in Table 2 and in Appendix A. The ΔT, required for heating load calculation, was derived by subtracting the reported hourly dry bulb outside air temperature data from 72. The total base heating load estimate, for the winter months period, was then calculated by using the following formula:

$$Q=(\Sigma_{i=1}^{2184}\Delta T(i)*(\Sigma_{j=1}^{n}U(j)*A(j))+I*H*\Delta T(i)) \quad \text{—2—}$$

All symbols used in Equation 2 are as defined for Equation 1. The number 2,184 refers to the hourly length of the winter months period. For each hourly time-interval the sum of the terms (U*A) and (I*H) remained constant for both DHL and HHL options. The term ΔT also remained constant at (72-21.9) degree F. for DHL method, but it was calculated based on measured hourly outside air temperature for the HHL method. The results of the calculations for seasonal total base heating load are shown in Table 2 for both options, for a single room building in Atlanta, Ga., assumed to be located at Atlanta International Airport.

TABLE 2

Calculated Winter Season Base Heating Load for a Single Room Building in Atlanta, Georgia, Based on Measured Hourly Outside Air Temperature at Atlanta International Airport and by Using the ASHRAE Design Heating Load Formula

| Single Room Exterior Elements | Area, sq. ft. | U, Heat Transfer Coefficient, BTU/hr.-sq ft-degree F. | Cumulative Hourly ΔT, Degree F. for Dec. 20, 2020, through Mar. 22, 2021 | Total Operational Base Heating Load, BTU | Cumulative Hourly ΔT, Degree F. for Dec. 20, 2020, through Mar. 22, 2021, by ASHRAE Method | Total Design Base Heating Load, BTU |
|---|---|---|---|---|---|---|
| Windows | 80 | 0.56 | 51.112 | 2,289,818 | 109,418.4 | 4,901,944 |
| Spandrel Wall | 120 | 0.077 | 51.112 | 472,275 | 109,418.4 | 1,011,026 |
| Brick Wall | 100 | 0.08 | 51.112 | 408,896 | 109,418.4 | 875,347 |
| Roof | 130 | 0.032 | 51.112 | 212,626 | 109,418.4 | 455,181 |
| Infiltration | 19.5(cfm) | 1.1 (BTU/hr. cfm-degree F) | 51.112 | 1,096,352 | 109,418.4 | 2,347,025 |
| Total Seasonal Base Heating Load, BTU | | | | 4,479,967 | | 9,590,523 |

TABLE 2-continued

Calculated Winter Season Base Heating Load for a Single Room Building in Atlanta, Georgia, Based on Measured Hourly Outside Air Temperature at Atlanta International Airport and by Using the ASHRAE Design Heating Load Formula

| Single Room Exterior Elements | Area, sq. ft. | U, Heat Transfer Coefficient, BTU/hr.-sq ft-degree F. | Cumulative Hourly ΔT, Degree F. for Dec. 20, 2020, through Mar. 22, 2021 | Total Operational Base Heating Load, BTU | Cumulative Hourly ΔT, Degree F. for Dec. 20, 2020, through Mar. 22, 2021, by ASHRAE Method | Total Design Base Heating Load, BTU |
|---|---|---|---|---|---|---|
| Average Hourly Base Heating Load, BTU/hr. | | | | 2,051 | | 4,391 |

Table 2 shows the summary of calculations performed for deriving the estimated operational base heating load, HHL, by using the reported hourly local air temperature data and, the DHL by using the ASHRAE formula. These data were calculated by assuming that the building would be in full operation during both daytime and nighttime hours. Based on the data shown above, it is apparent that the total seasonal base HHL, for the three-months winter period in Atlanta, Ga., is about 46.7 percent of the calculated base DHL. It is probable that the calculated operational hourly base heating load for the chosen system could be higher during colder winter seasons, in the given locale. However, over the long term, significant cost savings and environmental benefits could be achieved by automating and optimizing the fuel feed to the boilers in a building's HVAC system. The total heating load for a complex building would include allowance for HVAC system efficiency, burner efficiency, heat loss through conduits and vessels, the net heat load of building's internal operations and equipment, manufacturer specifications for the system heating units, and applicable Federal, State, and local regulations and code requirements.

The use of base hourly heating load calculation method, described in this invention, could result in a fuel saving of more than 50% in comparison to the current Boiler Set Point method. Based on U.S. Environmental Protection Agency Publication (epa.gov/ghgemissions/sources-greenhouse-gas-emissions), the annual greenhouse gas emissions, from commercial and residential building operations, was 1,733 million tons in 2020, constituting about 13% of the total annual GHG emissions in the U.S. A significant portion of these emissions were generated by fossil fuel consumption in building heating operations. Widespread adoption of the invention described in this Patent Application could result in a significant reduction in these emissions in the U.S., in the range of several hundred million tons per year.

The single room building was selected for providing the proof of concept in this Patent Application, based on the consideration that detailed DHL calculations were published for the hypothetical, single room building, in the 2017 issue of ASHRAE Handbook, and due to the lack of a major building equipped with an outside hourly air temperature monitoring system for various exterior orientations and the roof of the building.

For majority of existing buildings, installation of four dry bulb electronic outside air temperature probes near the vertical center line of each of the building's orientations, at or near the ground level, plus a thermometer located at the roof center, along with the associated data transmitters, would yield significant fuel saving for the building's heating system, by implementing the hourly heating load calculation method.

For high-rise buildings, the adiabatic lapse rate phenomenon, defined as the rate at which the temperature of an air parcel changes in response to compression or expansion associated with elevation change without exchanging any heat with its surroundings, causes a decrease in the air temperature at the rate of 5.5° F./1000 feet for increased height (Glossary-NOAA's National Weather Services). Also, redirection of prevailing winds along exterior surfaces of the building could increase or decrease the anticipated heating load. Therefore, it would be advisable to obtain data on outside air temperature versus building height during the winter season, by installing temporary thermometers at appropriate floor levels, such as 5 to 10 floors apart, along the vertical center line of the building's exterior surface area, in each orientation. The number and location of permanent thermometers, along the sides of the building, should then be determined based on the results of these measurements. The related hourly fuel feed calculation program should also be modified to calculate the base hourly heating load for the domain of each thermometer, including the roof center thermometer, and the total hourly heating load for the HVAC heating system.

When multiple dry bulb thermometers are installed along the Central vertical line of each building orientation, in a high-rise building, the domain of each thermometer would be based on the number and spacing of the installed dry bulb thermometers. As shown in FIG. 1, for an 800-foot-tall high-rise building, four thermometers could be installed along the vertical center line of each orientation, and the domain of each thermometer would have a height of 200 feet extending along the width of the associated orientation. The vertical domain of the bottom level thermometer should be measured from the ground level, and each of the remaining three thermometers should be installed in the middle of the vertical Centerline segment passing through the strip. Also, minor adjustment in the vertical height of each strip could be made to avoid dividing areas of uniform heat transmission characteristics into narrow strips. A data transmitter is shown in FIG. 1 in conjunction with the ground level thermometers by assuming that each transmitter would be capable of receiving data from the four electronic thermometers installed along the related vertical center line. If this objective cannot be achieved with current data transmitters, then a dedicated data transmitter would need to be installed adjacent to each dry bulb thermometer. The hourly air temperature data collected by each thermometer shall be transmitted to the HVAC heating system's dedicated computer or to a web file accessible to the central computer for computing the hourly base heating load for each orientation.

The technology for continuous outside air temperature measurement and reporting has been developed by the U.S. National Weather Service and such data are continuously reported on the World Wide Web for National Weather Service Climate Monitoring Stations. The thermometers and associated equipment used at these stations report the temperature data directly to a cloud-based computer system, where it is made available to the public on a continuous basis. Similar equipment could be adapted for air temperature measurements at a building's exterior orientations.

The base hourly heating load calculation method described above could also be applied to assess the base hourly wattage load for heating coils in electrically powered boilers.

The outside air temperature monitoring system, installed for heating load calculation during the winter season, could, potentially, be used to aid in assessing the hourly cooling load values for the air conditioning system in the same building, during the warmer seasons.

An Excel file showing the U.S. National Weather Service's hourly Climate Monitoring Data for a three-day period in Jan. 22-24, 2021, is shown in Table A-1 of Appendix A. Detailed information for the 31 three-day periods in 2020-2021 winter season, used in base heating load calculations, based on hourly air temperature data published by U.S. National Weather Service, for Atlanta Ga., is included in Table A-2 of Appendix A. Data included in Table A-2 also show that the sum of base heating load, for daytime and nighttime periods, would be close in Atlanta, Ga., if the building had operated at the same level during both periods.

The following are the required steps to enable automation and optimization of the hourly fuel feeding operation of the boilers, or the hourly wattage requirements for coil heating boilers, in the HVAC systems for large residential, commercial, and industrial buildings, the flowchart showing the required steps is shown in FIG. 2.

For majority of existing buildings a minimum of four outdoor wireless or wired electronic dry bulb thermometers should be installed, at the ground level or attached to the building's exterior wall on or near the central vertical line of each of the building's orientations, plus a single thermometer installed at the center of the building's roof. For high-rise buildings, data on wintertime air temperature profile along the height of the building should be collected to determine the proper number of required thermometers to be installed, along each building orientation. These thermometers should be capable of digital transmission of the measured air temperature and their assigned location number, at hourly time intervals, to the central fuel feed control computer, described below. The measured hourly air temperature at each thermometer location should be applied to all exterior surface areas, of different thermal transmission characteristics, in the same building orientation, or to the domain of each thermometer, when multiple thermometers are installed at different heights above the ground. The technology for measurement and cloud transmittal of the ambient air temperature has been developed by the U.S. National Weather Service, and is used nation-wide to report, instantaneous hourly climate data, at selected weather stations. The Finnish Firm Vaisala (www.Vaisala.com) provides electronic air temperature probes, as well as the transmitters for downloading the data to an internet account, or a central computer.

Installation of a dedicated computer system, or cloud service, programmed to calculate the HVAC base heating load at hourly intervals, by using the stored data on areal extent of the exterior surfaces (A) for each building orientation and the roof, along with the related heat transfer coefficients (U), and calculated temperature difference ($\Delta T$) between desired interior temperature (72 degree F.) and the relayed hourly exterior air temperatures along each orientation, and the roof. An integration of the product of multiplication of relevant constant factors for each orientation and the roof, with the related heat transmission coefficients and the reported $\Delta T$ value for that orientation should be carried out. The sum of these values, for all four orientations plus the roof, should be added to the product of required hourly air infiltration rate and its related heating factor, to arrive at the calculated base heating load for each hour. The program should then include allowance for all heat losses associated with fuel combustion in the heating units, as well as the losses from pipes, ducts, and vessels used in the heating system, and all heating load additions or reductions associated with the internal operations and equipment of the building, manufacturers' specifications for the heating units, and applicable codes and regulatory requirements, and add the sum of heat losses, and load gains or reductions to the calculated base heating load, to arrive at the total heating load for the following hourly time interval. Allowance should also be made for preheating the building for daily or nightly use before the scheduled start of such operations.

When multiple thermometers are installed along the vertical centerline of each building orientation, in major high-rise buildings, as shown in the schematic diagram of FIG. 1, the procedure described above should be followed for calculating the base heating load for the domain of each individual thermometer. The total base heating load for each orientation would then include the sum of these sub loadings.

If electric boilers are used in the HVAC system, the calculated total hourly heating load, should be expressed in watts and the wattage output from the coils should be automatically adjusted to meet the required hourly heating load.

If the outside air temperature falls below the minimum temperature value used to calculate the Design Heating Load for the HVAC System, the program should revert to setting the fuel feed level based on the minimum temperature used in Design Heating Load calculation, for each affected hour.

The control system should be capable of automatically adjusting the fuel feed valves, or the electric wattage control mechanism, serving the boiler units to provide the level of energy input called for in the steps listed above.

The air input rate for the boiler's burners should also be adjusted in conjunction with the boiler's automatic air-fuel mixture control system.

The control system should, also, be programmed to conform to other operational requirements unique to each HVAC system, such as nightly feed reduction, manual operation, manufacturer specifications, Federal, and State Code requirements, other override contingencies, and local regulatory requirements.

Time step intervals longer than one hour could also be considered, depending on the complexity and the observed response time of the buildings' heating systems.

REFERENCES

1. U.S. National Weather Service, Hourly Weather Data for Atlanta International Airport, Dec. 20, 2020, to Mar. 22, 2021.
2. 2017 ASHRAE Handbook, Fundamentals, Supported by ASHRAE Research. Chapter 18—Nonresidential Cooling and Heating Load Calculations, Section 9.2 Single Room Example Peak Heating Load, Page 18.24
3. 2019 ASHRAE Handbook, HVAC Applications, Supported by ASHRAE Research. Chapter 43—Supervisory Control Strategies and Optimization, Section 3.10—Control Strategies for Heating Systems.
4. 2020 ASHRAE Handbook, HVAC Systems and Equipment, Supported by ASHRAE Research. Chapter 32—Boilers, Section 7. Boiler Controls.
5. U.S. Environmental Protection Agency 2022 Web Publications: epa.gov/ghgemissions/sources-greenhouse-gas-emissions
6. Example of Manufacturer of Electronic Wireless Thermometers and Transmitters (www.Viasala.com)

APPENDIX A—SELECTED HOURLY DRY BULB AIR TEMPERATURE DATA FOR ATLANTA, GEORGIA AND ASSOCIATED ΔT VALUES USED FOR HEATING LOAD CALCULATIONS

TABLE A-1

Jan. 22-24, 2021, Hourly Delta T Calculations for Atlanta, Georgia

| | | U.S. National Weather Service | Hourly Delta T Values Calculated from 72 Degrees F. | | |
|---|---|---|---|---|---|
| Dates in January 2021 | Time | Reported Hourly Dry Bulb Air Temperature, Degree F. | Hourly Calendar Day Delta T | Daytime (6 A.M.-7 P.M) Total Delta T | Nighttime (7 P.M.-6 A.M.) Total Delta T |
| 24 | 23.52 | 53 | 19 | | |
| 24 | 22.52 | 53 | 19 | | |
| 24 | 21.52 | 54 | 18 | | |
| 24 | 20.52 | 55 | 17 | | |
| 24 | 19.52 | 55 | 17 | | |
| 24 | 18.52 | 56 | 16 | | 106 |
| 24 | 17.52 | 57 | 15 | | |
| 24 | 16.52 | 59 | 13 | | |
| 24 | 15.52 | 61 | 11 | | |
| 24 | 14.52 | 60 | 12 | | |
| 24 | 13.52 | 60 | 12 | | |
| 24 | 12.52 | 56 | 16 | | |
| 24 | 11.52 | 54 | 18 | | |
| 24 | 10.52 | 50 | 22 | | |
| 24 | 9.52 | 47 | 25 | | |
| 24 | 8.52 | 43 | 29 | | |
| 24 | 7.52 | 39 | 33 | | |
| 24 | 6.52 | 41 | 31 | | |
| 24 | 5.52 | 42 | 30 | 267 | |
| 24 | 4.52 | 42 | 30 | | |
| 24 | 3.52 | 46 | 26 | | |
| 24 | 2.52 | 47 | 25 | | |
| 24 | 1.52 | 47 | 25 | | |
| 24 | 0.52 | 49 | 23 | | |
| 23 | 23.52 | 49 | 23 | | |
| 23 | 22.52 | 50 | 22 | | |
| 23 | 21.52 | 50 | 22 | | |
| 23 | 20.52 | 51 | 21 | | |
| 23 | 19.52 | 52 | 20 | | |
| 23 | 18.52 | 54 | 18 | | 255 |
| 23 | 17.52 | 58 | 14 | | |

TABLE A-1-continued

Jan. 22-24, 2021, Hourly Delta T Calculations for Atlanta, Georgia

| | | U.S. National Weather Service | Hourly Delta T Values Calculated from 72 Degrees F. | | |
|---|---|---|---|---|---|
| Dates in January 2021 | Time | Reported Hourly Dry Bulb Air Temperature, Degree F. | Hourly Calendar Day Delta T | Daytime (6 A.M.-7 P.M) Total Delta T | Nighttime (7 P.M.-6 A.M.) Total Delta T |
| 23 | 16.52 | 61 | 11 | | |
| 23 | 15.52 | 61 | 11 | | |
| 23 | 14.52 | 61 | 11 | | |
| 23 | 13.52 | 59 | 13 | | |
| 23 | 12.52 | 56 | 16 | | |
| 23 | 11.52 | 54 | 18 | | |
| 23 | 10.52 | 50 | 22 | | |
| 23 | 9.52 | 43 | 29 | | |
| 23 | 8.52 | 38 | 34 | | |
| 23 | 7.52 | 35 | 37 | | |
| 23 | 6.52 | 35 | 37 | | |
| 23 | 5.52 | 37 | 35 | 288 | |
| 23 | 4.52 | 38 | 34 | | |
| 23 | 3.52 | 39 | 33 | | |
| 23 | 2.52 | 40 | 32 | | |
| 23 | 1.52 | 41 | 31 | | |
| 23 | 0.52 | 42 | 30 | | |
| 22 | 23.52 | 43 | 29 | | |
| 22 | 22.52 | 43 | 29 | | |
| 22 | 21.52 | 44 | 28 | | |
| 22 | 20.52 | 45 | 27 | | |
| 22 | 19.52 | 46 | 26 | | |
| 22 | 18.52 | 49 | 23 | | 322 |
| 22 | 17.52 | 53 | 19 | | |
| 22 | 16.52 | 56 | 16 | | |
| 22 | 15.52 | 58 | 14 | | |
| 22 | 14.52 | 57 | 15 | | |
| 22 | 13.52 | 53 | 19 | | |
| 22 | 12.52 | 49 | 23 | | |
| 22 | 11.52 | 48 | 24 | | |
| 22 | 10.52 | 47 | 25 | | |
| 22 | 9.52 | 46 | 26 | | |
| 22 | 8.52 | 46 | 26 | | |
| 22 | 7.52 | 45 | 27 | | |
| 22 | 6.52 | 45 | 27 | | |
| 22 | 5.52 | 46 | 26 | 287 | |
| 22 | 4.52 | 46 | 26 | | |
| 22 | 3.52 | 46 | 26 | | |
| 22 | 2.52 | 46 | 26 | | |
| 22 | 1.52 | 47 | 25 | | |
| 22 | 0.52 | 47 | 25 | | 128 |
| Jan. 22-24, 2021, Calculated Delta T Values for Atlanta, Georgia by Using Hourly Dry Bulb Air Temperature data reported by U.S. National Weather Service | | | 1653 | 842 | 811 |
| Number of Hours Involved | | | 72 | 39 | 33 |
| Jan. 22-24, 2021, Calculated Delta T Values for Atlanta, Georgia, by Using ASHRAE Design Heating Load Calculation Method's Hourly Delta T Value of (72-21.9) | | | 3607 | 1954 | 1653 |

TABLE A-2

Summary of Calculated Hourly Delta T Values by Using U.S. National Weather Service's Reported Hourly Outside Dry Bulb Air Temperature Values and the ASHRAE Method for HVAC Design Heating Load Calculation, for Winter Season 2020-21 in Atlanta, Georgia

| Date Interval | Calculated Calendar Day Delta T Values by Using Hourly Air Temperature Data | Calculated Daytime Delta T Values by Using Hourly Air Temperature Data | Calculated Nighttime Delta T Values by Using Hourly Air Temperature Data | Total Number of Hours | Daytime Hours (6:00 A.M. to 7.00 P.M.) | Nighttime Hours (7:00 P.M. to 6:00 A.M.) |
|---|---|---|---|---|---|---|
| Dec. 20-22, 2020 | 1,616 | 790 | 826 | 72 | 39 | 33 |
| Dec. 23-25, 2020 | 2,170 | 1,098 | 1,072 | 72 | 39 | 33 |
| Dec. 26-28, 2020 | 2,189 | 1,098 | 1,091 | 72 | 39 | 33 |
| Dec. 29-31, 2020 | 1,529 | 784 | 745 | 72 | 39 | 33 |
| Jan. 1-3, 2021 | 1,200 | 623 | 577 | 72 | 39 | 33 |
| Jan. 4-6, 2021 | 1,873 | 943 | 930 | 72 | 39 | 33 |
| Jan. 7-9, 2021 | 2,391 | 1,266 | 1,125 | 72 | 39 | 33 |
| Jan. 10-12, 2021 | 2,278 | 1,197 | 1,081 | 72 | 39 | 33 |
| Jan. 13-15, 2021 | 2,065 | 1,021 | 1,044 | 72 | 39 | 33 |
| Jan. 16-18, 2021 | 2,247 | 1,140 | 1,107 | 72 | 39 | 33 |
| Jan. 19-21, 2021 | 1,679 | 851 | 828 | 72 | 39 | 33 |
| Jan. 22-24, 2021 | 1,653 | 842 | 811 | 72 | 39 | 33 |
| Jan. 25-27, 2021) | 996 | 520 | 476 | 71 | 39 | 32 |
| Jan. 28-30, 2021) | 2,275 | 1,171 | 1,104 | 72 | 39 | 33 |
| Jan. 31-Feb. 2, 2021 | 2,298 | 1,236 | 1,062 | 72 | 39 | 33 |
| Feb. 3-5, 2021 | 2,009 | 1,059 | 950 | 72 | 39 | 33 |
| Feb. 6-8, 2021 | 2,055 | 1,033 | 1,022 | 72 | 39 | 33 |
| Feb. 9-11, 2021 | 1,043 | 500 | 543 | 72 | 39 | 33 |
| Feb. 12-14, 2021 | 1,898 | 1,022 | 876 | 72 | 39 | 33 |
| Feb. 15-17, 2021 | 2,451 | 1,331 | 1,120 | 72 | 39 | 33 |
| Feb. 18-20, 2021 | 2,203 | 1,167 | 1,036 | 72 | 39 | 33 |
| Feb. 21-23, 2021 | 1,456 | 701 | 755 | 72 | 39 | 33 |
| Feb. 24-26, 2021 | 969 | 455 | 514 | 72 | 39 | 33 |
| Feb. 27-Mar. 1, 2021 | 796 | 392 | 404 | 71 | 38 | 33 |
| Mar. 2-4, 2021 | 1,540 | 729 | 811 | 72 | 39 | 33 |
| Mar. 5-7, 2021 | 1,564 | 752 | 812 | 72 | 39 | 33 |
| Mar. 8-10, 2021 | 1,085 | 472 | 613 | 72 | 39 | 33 |
| Mar. 11-13, 2021 | 529 | 258 | 271 | 40 | 18 | 22 |

TABLE A-2-continued

Summary of Calculated Hourly Delta T Values by Using U.S. National Weather Service's Reported Hourly Outside Dry Bulb Air Temperature Values and the ASHRAE Method for HVAC Design Heating Load Calculation, for Winter Season 2020-21 in Atlanta, Georgia

| Date Interval | Calculated Calendar Day Delta T Values by Using Hourly Air Temperature Data | Calculated Daytime Delta T Values by Using Hourly Air Temperature Data | Calculated Nighttime Delta T Values by Using Hourly Air Temperature Data | Total Number of Hours | Daytime Hours (6:00 A.M. to 7.00 P.M.) | Nighttime Hours (7:00 P.M. to 6:00 A.M.) |
|---|---|---|---|---|---|---|
| Mar. 14-16, 2021 | 745 | 440 | 305 | 72 | 39 | 33 |
| Mar. 17-19, 2021 | 1,126 | 536 | 590 | 65 | 32 | 33 |
| Mar. 20-22, 2021 | 1,184 | 617 | 567 | 65 | 34 | 31 |
| Total Winter Season Hourly Delta T Values | 51,112 | 26,044 | 25,068 | 2,184 | 1,175 | 1,009 |
| Total Winter Season Delta T Values Calculated by ASHRAE Design Heating Load Method* | 109,418 | 58,868 | 50,551 | | | |
| Ratio of Seasonal Hourly Delta T Values to ASHRAE Method's Seasonal Delta T Values | 46.71% | 44.24% | 49.59% | | | |

*These values were calculated by multiplying the seasonal number of hours in each of the three categories by (72-21.9) to arrive at the total winter season Delta T value per ASHRAE Design Heating Load Calculation Method

The invention claimed is:

1. A method for reducing energy consumption for heating elements of a heating, ventilation, and air conditioning (HVAC) system for a building, the method comprising:

measuring an hourly outside air temperature using a plurality of dry bulb electronic thermometers installed along vertical center lines of a plurality of orientations of the building and at a center of a roof of the building; and automatically adjusting an hourly fuel feed rate to the heating elements of the HVAC system based on the measured hourly outside air temperature and a desired indoor temperature of the building, to reduce the energy consumption of the heating elements of the HVAC system by 50% compared to manually adjusting a boiler temperature set point.

2. The method of claim 1, wherein the automatically adjusting the hourly fuel feed rate reduces fuel consumption and greenhouse gas emissions by up to 50%.

3. The method of claim 1, further comprising:

determining a base hourly heating load based on square footage data and heat transfer coefficients of each subarea of the plurality of orientations of the building, with distinct heat transmission characteristics.

4. The method of claim 1, further comprising:

for each of the plurality of dry bulb electronic thermometers, determining a base hourly heating load for an assigned domain of the respective dry bulb electronic thermometer.

5. The method of claim 1, further comprising:

determining a total base hourly heating load by summing a base hourly heating load for all domains of the plurality of dry bulb electronic thermometers and adding a heating load of an hourly air infiltration rate of the building.

6. The method of claim 5, further comprising:

determining a total hourly heating load of the HVAC system by adjusting the base hourly heating load based on an overall efficiency of the HVAC system, load requirements for internal building operations and equipment, code and regulatory compliance requirements, and manufacturers' specifications.

7. The method of claim 6, further comprising:

determining the hourly fuel feed rate to the heating elements of the HVAC system based on the determined total hourly heating load.

8. The method of claim 1, further comprising:

in accordance with the hourly outside air temperature being below a minimum outside air temperature used to calculate a design heating load for the HVAC system, setting the hourly fuel feed rate to the heating elements of the HVAC system based on the minimum outside air temperature.

9. A temperature control system for reducing energy consumption for heating elements of a heating, ventilation, and air conditioning (HVAC) system for a building, the temperature control system comprising:

a plurality of dry bulb electronic thermometers that measure hourly outside air temperature, wherein the plurality of dry bulb electronic thermometers is installed along vertical center lines of a plurality of orientations of the building and at a center of a roof of the building;

a plurality of data transmitters for transmitting the measured hourly outside air temperature; and a dedicated computer that automatically adjusts an hourly fuel feed rate to the heating elements of the HVAC system based on the measured hourly outside air temperature to reduce the energy consumption of the heating elements of the HVAC system by 50% compared to manually adjusting a boiler temperature set point.

10. The temperature control system of claim 9, wherein the dedicated computer that automatically adjusts the hourly fuel feed rate comprises the dedicated computer that automatically adjusts the hourly feel feed rate to reduce fuel consumption and greenhouse gas emissions by up to 50%.

11. The temperature control system of claim 9, wherein the dedicated computer further:

determines a base hourly heating load based on square footage data and heat transfer coefficients of each subarea of the plurality of orientations of the building, with distinct heat transmission characteristics.

12. The temperature control system of claim 9, wherein the dedicated computer further:

determines, for each of the plurality of dry bulb electronic thermometers, a base hourly heating load for an assigned domain of the respective dry bulb electronic thermometer.

13. The HVAC system of claim 9, wherein the dedicated computer further:

determines a total hourly heating load of the HVAC system by adjusting the base hourly heating load based on an overall efficiency of the heating elements of the HVAC system, load requirements for internal building operations and equipment, code and regulatory compliance requirements, and manufacturers' specifications.

14. The HVAC system of claim 13, wherein the dedicated computer further:

determines the hourly fuel feed rate to the heating elements of the HVAC system based on the determined total hourly heating load.

15. The temperature control system of claim 9, wherein the dedicated computer further:

sets the hourly fuel feed rate to the heating elements of the HVAC system based on a minimum outside air temperature used to calculate a design heating load for the HVAC system, in accordance with the hourly outside air temperature being below the minimum outside air temperature.

16. The temperature control system of claim 9, wherein a number of the plurality of dry bulb electronic thermometers and a number of data transmitters along each orientation of the building are determined based on data collected on outside air temperature versus building height obtained during a winter season using temporary thermometers located at every 5-10 floors spacing, along the vertical center line of each of the plurality of orientations of the building.

17. The temperature control system of claim 9, wherein, for each of the plurality of orientations of the building, a number of the plurality of dry bulb electronic thermometers is equal to one and a number of the plurality of data transmitters is equal to one.

* * * * *